US009943894B2

(12) United States Patent
Evertz et al.

(10) Patent No.: US 9,943,894 B2
(45) Date of Patent: Apr. 17, 2018

(54) METHOD FOR PRODUCING A COMPONENT BY HOT FORMING A PRE-PRODUCT MADE OF STEEL

(75) Inventors: Thomas Evertz, Peine (DE); Volker Flaxa, Salzgitter (DE); Michael Braun, Lehre (DE)

(73) Assignee: SALZGITTER FLACHSTAHL GMBH, Salzgitter (DE)

( * ) Notice: Subject to any disclaimer, the term of this patent is extended or adjusted under 35 U.S.C. 154(b) by 395 days.

(21) Appl. No.: 14/234,020

(22) PCT Filed: Jul. 4, 2012

(86) PCT No.: PCT/DE2012/000685

§ 371 (c)(1),
(2), (4) Date: Apr. 8, 2014

(87) PCT Pub. No.: WO2013/010524

PCT Pub. Date: Jan. 24, 2013

(65) Prior Publication Data

US 2014/0290322 A1 Oct. 2, 2014

(30) Foreign Application Priority Data

Jul. 20, 2011 (DE) ..... 10 2011 108 162

(51) Int. Cl.

| | |
|---|---|
| ***C21D 7/02*** | (2006.01) |
| ***B21B 1/02*** | (2006.01) |
| ***B21D 22/20*** | (2006.01) |
| ***C21D 7/13*** | (2006.01) |
| ***C21D 9/08*** | (2006.01) |
| ***C21D 9/48*** | (2006.01) |
| ***B21B 1/38*** | (2006.01) |
| ***B21C 1/00*** | (2006.01) |
| *C21D 1/673* | (2006.01) |

(52) U.S. Cl.

CPC ..... *B21B 1/024* (2013.01); *B21B 1/38* (2013.01); *B21C 1/00* (2013.01); *B21D 22/208* (2013.01); *C21D 7/02* (2013.01); *C21D 7/13* (2013.01); *C21D 9/08* (2013.01); *C21D 9/48* (2013.01); *B21B 2001/383* (2013.01); *C21D 1/673* (2013.01)

(58) Field of Classification Search

CPC . B21D 37/16; C21D 1/42; C21D 7/02; C21D 7/04; C21D 7/13; C21D 8/0284; C21D 8/0484; C21D 9/08; C21D 9/46

USPC ..... 72/46, 47

See application file for complete search history.

(56) References Cited

U.S. PATENT DOCUMENTS

| | | | | |
|---|---|---|---|---|
| 4,462,238 | A * | 7/1984 | Goodfellow | C21D 7/10 72/352 |
| 7,758,707 | B2 * | 7/2010 | Millward | C21D 1/18 148/325 |
| 7,832,242 | B2 * | 11/2010 | Brandstatter | C21D 1/673 148/262 |
| 2001/0042393 | A1 * | 11/2001 | Kefferstein | B21D 22/20 72/47 |
| 2006/0169368 | A1 * | 8/2006 | Lopez | C21D 8/00 148/332 |
| 2009/0250147 | A1 * | 10/2009 | Nishida | C21D 9/46 148/645 |
| 2013/0125607 | A1 * | 5/2013 | Samek et al. | 72/364 |

FOREIGN PATENT DOCUMENTS

| | | | | |
|---|---|---|---|---|
| DE | 43 18 931 | C1 | 12/1993 | |
| DE | 4318931 | C1 * | 12/1994 | |
| DE | 10 2004 028 236 | B3 | 11/2005 | |
| DE | 601 19 826 | T2 | 12/2006 | |
| DE | 10 2008 020 757 | A1 | 11/2008 | |
| DE | 10 2008 050 315 | A1 | 5/2009 | |
| DE | 102008050315 | A1 * | 5/2009 | B21D 22/02 |
| EP | 2 457 673 | A1 | 5/2012 | |
| WO | PCT/EP2011/057280 | * | 5/2011 | |
| WO | WO 2011/141367 | A1 | 11/2011 | |

OTHER PUBLICATIONS

English machine translation of DE 102008050315.*

Franz-Josef Lenze et al: Herstellung von Karosseriebauteilen aus warmumgeformten höchstfesten Stahlwerkstoffen (Production of vehicle body structural parts from hot formed ultra high strength steel materials), EFB (European research center for sheet metal processing), conference proceedings, vol. 25, Jan. 1, 2005 p. 53-61, XP009098694.

* cited by examiner

*Primary Examiner* — Debra Sullivan

(74) *Attorney, Agent, or Firm* — Henry M. Feiereisen, LLC

(57) ABSTRACT

In a method for producing a component by hot forming of a pre-product made of steel, the pre-product is heated to forming temperature and subsequently formed. The product is heated to a temperature below the $AC_1$-transformation temperature and undergoes a strength increase prior to the heating by cold forming.

13 Claims, No Drawings

METHOD FOR PRODUCING A COMPONENT BY HOT FORMING A PRE-PRODUCT MADE OF STEEL

CROSS-REFERENCES TO RELATED APPLICATIONS

This application is the U.S. National Stage of International Application No. PCT/DE2012/000685, filed Jul. 4, 2012, which designated the United States and has been published as International Publication No. WO 2008/049764 and which claims the priority of German Patent Application, Serial No. 10 2011 108 162.7, filed Jul. 20, 2011, pursuant to 35 U.S.C. 119(a)-(d).

BACKGROUND OF THE INVENTION

The invention relates to a method for producing a component by hot forming a pre-product made of steel according to the preamble of patent claim 1. In the following, pre-products include for example sheet metal plates or seamless pipes or respectively, welded pipes.

Such components are predominantly used in the automobile industry but may also be used in mechanical or civil engineering.

The hotly contested automobile market forces manufacturers to constantly seek solutions for lowering the fleet consumption, while at the same time maintaining a highest-possible comfort and occupant protection. In this context, weight-saving plays an important role, on the other hand also properties of the individual components that promote the passive safety of the passengers during high static and dynamic stresses during operation and in case of a crash.

Suppliers of starting material seek to account for this demand by providing high-strength and ultra-high-strength steels which allow reducing wall thicknesses while at the same time providing improved properties of the components during manufacture and during use.

These steels therefore have to satisfy relatively high standards regarding strength, stretchability, tenacity, energy absorption and corrosion resistance as well as their processability for example during cold forming and during welding.

In light of the aforementioned aspects, the production of components made of hot formable steels is gaining importance because these ideally meet the increased demands placed on the component properties while at the same time requiring less material.

The production of components by means of quenching of pre-products made of press hardenable steels by hot forming in a forming tool is known from DE 601 19 826 12. Here, a sheet metal plate which has been heated above austenizing temperature to 800-1000° C. beforehand and may optionally be covered with a metallic coating on zinc basis, is formed into a component in an optionally cooled tool, wherein during the forming the sheet metal plate or component undergoes a quench hardening (press hardening) by rapid heat withdrawal and as a result attains the required strength properties. The metallic coating is applied as corrosion protection, usually in the continuous hot dip coating, onto a hot strip or cold strip or respectively onto the pre-product produced therefrom, for example as hot dip galvanizing or hot dip aluminizing.

Subsequently, the plate is cut to size for the forming tool in accordance with the hot forming. It is also possible to provide the respective work piece to be formed or the cut with a hot dip coating.

The application of a metallic coating onto the pre-product to be formed prior to the hot forming is advantageous in this method because the coating effectively avoids scaling of the base material, and as a result of the additional lubricating effect, excessive tool wear.

Known hot formable steels for this field of application are for example the manganese-boron steel "22MnB5" and recently also air-hardenable steels according to a not yet published patent application of the applicant.

The production of a component by hot forming by means of the known methods has multiple disadvantages.

On one hand this method requires very high amounts of energy due to the heating of the pre-product to austenizing temperature and the transformation of ferrite into austenite, which renders the method expensive and produces significant amounts of $CO_2$.

In addition, for avoiding excessive scaling of the sheet metal surface as described above an additional metallic protective layer or a protective lacquer based layer is required or a significant post processing of the surface that has undergone scaling as a result of heating and forming.

Because the forming above the $AC_3$-temperature, usually takes place at temperatures significantly above 800° C., extremely high requirements are placed on these layers regarding temperature stability.

A further disadvantage is also that for attaining corresponding strength of the components after the press hardening, only transformation-capable steels with a sufficiently slow transformation can be used which require correspondingly expensive alloy additions for the microstructure and hardness to be achieved after the forming.

In summary, the known method for producing components from steel by forming above austenizing temperature is very cost-intensive due to high energy costs and expensive materials which leads to high prices for components. For improving the forming capacity of high-strength steels it is known from DE10 2004 028 236 B3 to further process work pieces instead by cold forming, by a hot forming at temperatures from 400 to 700° C. to a component (warm forming). It is also disadvantageous in this method in a high component strength can only be obtained by using materials which are of higher strength and with this expensive.

SUMMARY OF THE INVENTION

It is an object of the invention to set forth a method for producing a component by hot forming is cost-effective and with which terrible or improved properties of the component can be achieved as in known hot forming by press hardening.

According to the teaching of the invention, this object is solved by a method in which the pre-product is heated during the method to a temperature below $AC_1$-transformation temperature and the pre-product undergoes a strength increase by cold forming prior to the heating.

DETAILED DESCRIPTION OF PREFERRED EMBODIMENTS

Compared to the methods known from DE 601 19 826 T2 for producing a component, the method according to the invention has the advantage that the strength of the component after the forming is essentially achieved by the strain hardening introduced into the pre product beforehand at significantly lower energy requirement for the heating. This saves energy and alloying costs. The introduced dislocations lead to a significant increase in strength, which is only insignificantly reduced by the heating process so that the strength of the component can be adjusted in a targeted manner. Tests have shown that the ductility of the finished component could be significantly increased compared to a component produced by press hardening.

For flat products such as hot strip, in the method according to the invention the so called "cold rolling", i.e., a rolling at room temperature with comparably low deformation degrees is used from which the plates to be formed are cut. In the case of seamless or welded pipes produced from hot strip the pipes are subjected to a corresponding deformation for example by cold drawing.

In order to render the strength increase, which was previously introduced into the pre product by cold forming, effective in the finished component, the degree of cold forming should not be below 3%, advantageously not below 5%, depending on the used material of the pre-product.

Advantageous in the case of hot strip are degrees of deformation, which are between the conventional temper rolling at about 3% and the cold rolling at about 50%-80%. However, the invention can also be used without problems at the higher degrees of deformation of the cold rolling. In praxis, cold deformation degrees in the range of from 5 to 35% have proven very well.

Comparable degrees of deformation apply for the use of pipes as pre-products.

Tests have shown that the thus established significant increase of the dislocation density can be preserved to a significant degree by the significantly lower re-heating temperatures below $AC_1$-temperature compared to the classical hot forming process by means of press hardening, and with this also contributes permanently to the strength of the formed product also after the warm forming. The dislocations newly formed during the forming at the low forming temperature are also partially retained.

Compared to DE 10 2004 028 236 B3, an increased component strength can now be achieved by a simple cold forming step on the pre-product prior to the hot forming instead of using higher-strength materials.

However, it is also possible in the method according to the invention to use higher strength materials, in addition to the strength increase by cold forming of the pre-product, for example when a very significant strength increase of the component is to be achieved.

The invention can be used for pre products made of soft to high strength steels for example with yield strengths of 140 MPa to 1200 MPa, which can be provided with a scale- or corrosion-inhibiting layer as metallic coating. The metallic coating can contain Zn and/or Mg and/or Al and/or Si.

As higher-strength steels all one phase but also multi phase steel types are used. This includes micro-alloyed higher-strength steel types as well as bainitic or martensitic types and dual- or multi-phase steels.

In contrast to the conventional production paths, a hot strip, which is already surface treated, can be used for the forming subsequent to a heating because the adhesion and the ductility can withstand a warm forming with low degrees of deformation. The metallic coating is resistant against short-time re-heatings of the combination substrate/coating (steel strip/coating) below $AC_1$-temperature of the substrate in order to withstand the re-heating prior to the warm forming and the actual warm forming.

Due to the comparably low amount of heat, large-scale re-heating aggregates such as pusher type furnaces or chamber furnaces can be suspended with in favor of fast and directly acting systems (inductive, conductive and in particular radiation).

In addition, significantly lower heat energy is required for the described method or respectively, the energetic efficiency is higher than in the case of press hardening. As a result the process costs are lower and the $CO_2$ emission is reduced.

Preferably, the re-heating occurs prior to the warm forming by means of radiation because in this case the efficiency is significantly higher than in the case of heating in a furnace or in the case of inductive heating, and energy is introduced into the material faster and more effectively depending on the surface properties.

By using radiators it is also possible to heat individual regions of the work piece to be formed in a targeted manner in order to attain stress-optimized components.

For the transport between heat source and forming tool it can further be useful, in particular in the case of very thin steel sheets (for example <0.8 mm), to provide the cuts with a profiling to increase the local stiffness. This is not possible in the convectional press hardening because the strength to be achieved requires an abrupt cooling, which cannot occur via the inner surface in the tool due to the profiling.

In the method according to the invention, the cold formed pre-product is heated to a temperature of below 720° C., advantageously in a temperature range from 400-700° C., and subsequently formed to a component. The optimal forming temperature depends on the required strength of the component and is preferably between about 540° C. and 700° C.

The forming (pressing) results in the introduction of further dislocations in addition to the prior clod rolling, via which further dislocations a further strength increased can be established because the temperature required for completely extinguish the dislocations in the sense of re crystallization or recovery is not sufficient in cycle times used in the industry of maximally 15 s per component or significantly below.

Together with the inhibition of dislocations by interstitially resolved elements (for example C, B, N) a further strength increase is enabled during the pressing and the subsequent cooling as a result of the so-called "bake-hardening effect" or by an additional precipitation formation, for example VC. As an alternative, the strength can be increased by a controlled cooling or a later heat treatment (for example burning in varnish or stress relieve annealing).

In an advantageous embodiment of the invention during the heating of the pre product to forming temperature the temperature range of the warm forming is locally exceeded into the austenization region in order to change properties locally in a targeted manner (for example local hardening), which in combination with the strength increase of the remaining material is adjusted to the later demands on the component.

What is claimed is:

1. A method for producing a component by hot forming of a pre-product made of steel, comprising;

subjecting the pre-product to a deformation by cold drawing or cold rolling with a deformation degree of at least 3%, whereby the pre-product undergoes a strength increase as a result of the deformation;

heating the pre-product to forming temperature below AC1-transformation temperature; and forming the pre-product by hot forming at the forming temperature into the component.

2. The method of claim 1, wherein the deformation degree is at least 5%.

3. The method of claim 1, wherein the deformation degree is between 5-35%.

4. The method of claim 1, wherein the pre-product is heated in the heating step to a temperature below 720° C.

5. The method of claim 4, wherein the pre-product is heated in the heating step to a temperature in the range from 400 to 700° C.

6. The method of claim 5, wherein the pre-product is heated in the heating step to a temperature in the range from 540 to 700° C.

7. The method of claim 1, further comprising prior to the heating step providing the pre-product with a metallic or lacquer-like coating.

8. The method of claim 7, further comprising prior to the deformation step providing the pre-product with a metallic or lacquer-coating.

9. The method of claim 7, wherein the metallic coating contains at least one element selected from the group consisting of Zn, Mg, Al and Si.

10. The method of claim 1, wherein the heating to the forming temperature occurs inductively, conductively or by means of radiation.

11. The method of claim 1, wherein the pre-product is a sheet metal plate or a pipe.

12. The method of claim 11, wherein the sheet metal plate is made of hot strip.

13. The method of claim 11, wherein the pipe is a seamlessly rolled pipe or a welded pipe produced from hot strip.

* * * * *